US010443116B2

(12) United States Patent
Hoshino et al.

(10) Patent No.: US 10,443,116 B2
(45) Date of Patent: Oct. 15, 2019

(54) METHOD FOR MANUFACTURING ZINC-BASED COATED STEEL SHEET

(71) Applicant: JFE Steel Corporation, Tokyo (JP)

(72) Inventors: Katsuya Hoshino, Tokyo (JP); Shinichi Furuya, Tokyo (JP); Takeshi Matsuda, Tokyo (JP); Kazuaki Tsuchimoto, Tokyo (JP); Akira Matsuzaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/082,632

(22) PCT Filed: Feb. 16, 2017

(86) PCT No.: PCT/JP2017/005604
§ 371 (c)(1),
(2) Date: Sep. 6, 2018

(87) PCT Pub. No.: WO2017/154495
PCT Pub. Date: Sep. 14, 2017

(65) Prior Publication Data

US 2019/0093206 A1 Mar. 28, 2019

(30) Foreign Application Priority Data

Mar. 11, 2016 (JP) ..... 2016-047816

(51) Int. Cl.
*C23C 22/06* (2006.01)
*C23C 22/53* (2006.01)
(Continued)

(52) U.S. Cl.
CPC ..... *C23C 2/06* (2013.01); *C23C 2/26* (2013.01); *C23C 22/34* (2013.01); *C23C 22/82* (2013.01)

(58) Field of Classification Search
CPC .. C23C 2/06; C23C 2/26; C23C 22/23; C23C 22/82
(Continued)

(56) References Cited

U.S. PATENT DOCUMENTS

2011/0083580 A1* 4/2011 Cheng ..... C23C 22/86 106/14.05
2017/0016121 A1* 1/2017 Hoshino ..... B32B 15/04

FOREIGN PATENT DOCUMENTS

EP 3112501 A1 1/2017
JP 5641387 A 4/1981
(Continued)

OTHER PUBLICATIONS

Japanese Office Action for Japanese Application No. 2016-047816, dated Feb. 5, 2019, with Concise Statement of Relevance of Office Action—5 page.
(Continued)

*Primary Examiner* — Dah-Wei D. Yuan
*Assistant Examiner* — Kristen A Dagenais-Englehart
(74) *Attorney, Agent, or Firm* — RatnerPrestia

(57) ABSTRACT

Provided is a method for manufacturing a zinc-based coated steel sheet having excellent press formability. The method includes an oxide layer-forming step of bringing the zinc-based coated steel sheet into contact with an acidic solution, holding the zinc-based coated steel sheet for 1 second to 60 seconds, and then water-washing the zinc-based coated steel sheet and a neutralization step of holding a zinc-based oxide layer formed in the oxide layer-forming step for 0.5 seconds or more in such a state that a surface of the zinc-based oxide layer is in contact with an alkaline aqueous solution, water-washing the zinc-based oxide layer, and then drying the zinc-based oxide layer. The acidic solution contains $HF_2Na$ and/or $HF_2K$ in a total amount of 0.10 g/L to 5.0 g/L.

4 Claims, 1 Drawing Sheet

(51) Int. Cl.

| | |
|---|---|
| ***C23C 22/83*** | (2006.01) |
| ***C23C 2/06*** | (2006.01) |
| ***C23C 22/34*** | (2006.01) |
| ***C23C 2/26*** | (2006.01) |
| ***C23C 22/82*** | (2006.01) |

(58) Field of Classification Search
USPC ..... 427/337
See application file for complete search history.

(56) References Cited

FOREIGN PATENT DOCUMENTS

| | | | | |
|---|---|---|---|---|
| JP | 56119782 | A | 9/1981 | |
| JP | 63274777 | A | 11/1988 | |
| JP | 2002256448 | A | 9/2002 | |
| JP | 2003306781 | A | 10/2003 | |
| JP | 2004003004 | A | 1/2004 | |
| JP | 2010090401 | A | 4/2010 | |
| JP | 2013100600 | A | 5/2013 | |
| WO | 2015129282 | A1 | 9/2015 | |
| WO | 2015129283 | A1 | 9/2015 | |
| WO | WO-2015129283 | A1 * | 9/2015 | ..... B32B 15/04 |

OTHER PUBLICATIONS

International Search Report and Written Opinion for International Application No. PCT/JP2017/005604, dated Mar. 14, 2017—5 pages.

Extended European Search Report for European Application No. 17762838.5, dated Dec. 4, 2018, 8 pages.

Japanese Office Action for Japanese Application No. 2016-047816, dated Sep. 4, 2018 with Concise Statement of Relevance of Office Action, 6 pages.

* cited by examiner

METHOD FOR MANUFACTURING ZINC-BASED COATED STEEL SHEET

CROSS REFERENCE TO RELATED APPLICATIONS

This is the U.S. National Phase application of PCT/JP2017/005604, filed Feb. 16, 2017, which claims priority to Japanese Patent Application No. 2016-047816, filed Mar. 11, 2016, the disclosures of these applications being incorporated herein by reference in their entireties for all purposes.

TECHNICAL FIELD OF THE INVENTION

The present invention relates to a method for manufacturing a zinc-based coated steel sheet having low sliding resistance and excellent press formability during press forming.

BACKGROUND OF THE INVENTION

Zinc-based coated steel sheets are widely used in a wide range of fields, especially for automotive body applications. In such applications, the zinc-based coated steel sheets are press-formed for use. However, the zinc-based coated steel sheets have a disadvantage that the zinc-based coated steel sheets are inferior in press formability to cold-rolled steel sheets. This is because the sliding resistance of the zinc-based coated steel sheets to press molds is higher than that of the cold-rolled steel sheets. A zinc-based coated steel sheet is hard to be fed into a press mold at a portion which has high sliding resistance to a mold or a bead; hence, the steel sheet is likely to be fractured.

In particular, in a galvanized steel sheet (hereinafter referred to as GI in some cases), a phenomenon in which sliding resistance further rises due to the adhesion of a coating to a mold (mold galling) occurs to cause cracking halfway through continuous press forming, thereby negatively affecting the productivity of automobiles.

Furthermore, from the viewpoint of tightening regulations on $CO_2$ emissions in recent years, the usage rate of high-strength steel sheets tends to increase for the purpose of reducing automobile weight. The use of a high-strength steel sheet increases the surface pressure during press forming and therefore the adhesion of a coating to a mold is a more serious problem.

As a method for solving the above problem, Patent Literatures 1 and 2 disclose a technique for enhancing press formability in such a manner that a galvannealed steel sheet (hereinafter referred to as GA in some cases) which is alloyed is temper-rolled, is brought into contact with an acidic solution with a pH buffering action, is left for 1 second to 30 seconds after the end of contact, is water-washed, and is then dried such that zinc-based oxides are formed on a surface layer of the GA.

As for the GI, the GI has particularly low surface activity. This is because a small amount of Al is added to a galvanizing bath for the purpose of adjusting the alloying reaction of base iron with zinc, Al oxides derived from Al in the bath are present on a surface of the galvanized steel sheet, and the galvanized steel sheet has a higher concentration of Al oxide on the surface as compared to the GA.

As a method for forming the zinc-based oxides described in Patent Literatures 1 and 2, Patent Literature 3 discloses a method in which such a GI with low surface activity is brought into contact with an alkali solution before being brought in contact with an acidic solution such that surface Al oxides are removed, a surface is activated, and the formation of oxides is promoted.

As a method for forming an oxide layer containing a crystalline structure substance represented by $Zn_4(SO_4)_{1-x}(CO_3)_x(OH)_6.nH_2O$, Patent Literature 4 discloses a method in which a similar GI with low activity is brought into contact with an alkali solution before contact with an acidic solution such that surface Al oxides are removed, a surface is activated, and the formation of oxides is promoted.

Patent Literature 5 discloses a method in which a steel sheet coated with a Zn—Al-based coating containing 20% to 95% by mass Al is brought into contact with an alkali solution and then HF is added to an acidic treatment solution such that the formation of an oxide layer is promoted.

PATENT LITERATURE

Patent Literature 1: Japanese Unexamined Patent Application Publication No. 2002-256448

Patent Literature 2: Japanese Unexamined Patent Application Publication No. 2003-306781

Patent Literature 3: Japanese Unexamined Patent Application Publication No. 2004-3004

Patent Literature 4: International Publication No. WO 2015/129283

Patent Literature 5: Japanese Unexamined Patent Application Publication No. 2010-90401

SUMMARY OF THE INVENTION

In order to form zinc-based oxides on a surface of a GI with low surface activity, an alkali pretreatment such as contact with an alkali solution is necessary to remove surface Al oxides as described in Patent Literature 3. So, it is essential for a manufacturing line provided with no alkali pretreatment unit that a new alkali pretreatment unit is installed. If no alkali pretreatment unit can be installed in a line from a line layout viewpoint, any GI having zinc-based oxides formed on a surface cannot be manufactured.

For both GIs and GAs, it is preferable that the thickness of a zinc-based oxide layer on a surface is large and the area fraction thereof is high from the viewpoint of enhancing sliding characteristics during press forming. In the case of performing no alkali pretreatment, the thickness of an oxide is small and the area fraction thereof is low.

Furthermore, the addition of HF to an acidic treatment solution as described in Patent Literature 5 is not practical on an industrial scale from the viewpoints of the toxicity of HF to the human body and the corrosivity of HF to facilities.

The present invention has been made in view of such circumstances. It is an object of the present invention to provide a method for manufacturing a zinc-based coated steel sheet with excellent press formability.

In order to solve the above problem, the inventors have performed various investigations on the surface treatment of zinc-based coated steel sheets. As a result, the inventors have found the following and have completed the present invention.

A zinc-based oxide layer containing a crystalline structure substance represented by $Zn_4(SO_4)_{1-x}(CO_3)_x(OH)_6.nH_2O$ can be formed in such a manner that a steel sheet is coated with zinc-based coating, is temper-rolled, is brought into contact with an acidic solution containing $HF_2Na$ and/or $HF_2K$ in a total amount of 0.10 g/L to 5.0 g/L, is held for 1 second to 60 seconds after the end of contact, and is then water-washed. As a result of disclosure provide herein, a zinc-based coated steel sheet with excellent press formability can be manufactured without any alkali activation treatment.

Aspects of the present invention have been made on the basis of the above finding and is as summarized below.

[1] A method for manufacturing a zinc-based coated steel sheet having a zinc-based oxide layer on a surface thereof includes an oxide layer-forming step of bringing a zinc-based coated steel sheet into contact with an acidic solution, holding the zinc-based coated steel sheet for 1 second to 60 seconds, and then water-washing the zinc-based coated steel sheet and a neutralization step of holding a zinc-based oxide layer formed in the oxide layer-forming step for 0.5 seconds or more in such a state that a surface of the zinc-based oxide layer is in contact with an alkaline aqueous solution, water-washing the zinc-based oxide layer, and then drying the zinc-based oxide layer. The acidic solution contains $HF_2Na$ and/or $HF_2K$ in a total amount of 0.10 g/L to 5.0 g/L.

[2] In the method for manufacturing the zinc-based coated steel sheet specified in Item [1], the acidic solution contains at least one or more of surfactants among cationic surfactants, anionic surfactants, nonionic surfactants, and amphoteric surfactants.

[3] In the method for manufacturing the zinc-based coated steel sheet specified in Item [1] or [2], the zinc-based oxide layer contains a crystalline structure substance represented by $Zn_4(SO_4)_{1-x}(CO_3)_x(OH)_6.nH_2O$.

Besides, in the present invention, steel sheets coated with zinc by various processes, for example, such as a hot dipping process, an electroplating process, a deposition plating process, and a spraying process are collectively referred to as zinc-based coated steel sheets. The zinc-based coated steel sheets include galvanized steel sheets (GIs) which are unalloyed and galvannealed steel sheets (GAs) which are alloyed.

According to the present invention, a zinc-based coated steel sheet with excellent press formability can be obtained. Since the coefficient of friction during press forming is low, the steel sheet has low sliding resistance at a crack risk portion and good stretchability is achieved. Accordingly, excellent press formability can be obtained even when a high-strength zinc-based coated steel sheet is press-formed or a zinc-based coated steel sheet with relatively low strength is press-formed into a complex shape.

A zinc-based oxide coating with excellent sliding characteristics can be stably formed even on a GI that has low surface activity without alkali-pretreatment. Thus, an industrially practical method for manufacturing a zinc-based coated steel sheet can be provided.

DETAILED DESCRIPTION OF EMBODIMENT OF THE INVENTION

Figure 1:
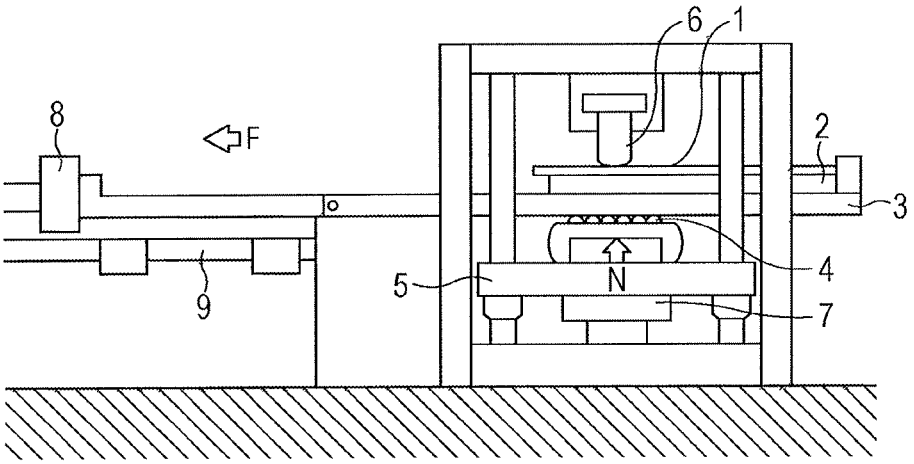
FIG. 1 is a schematic front view of a coefficient-of-friction tester.

Embodiments of the present invention are described below in detail.

In the course of manufacturing a zinc-based coated steel sheet, a steel sheet after being zinc-coated is usually temper-rolled for the purpose of ensuring stable quality. A GI to be subjected to working such as pressing is temper-rolled by using dull rolls. This is because since the GI, which is not alloyed after coating, otherwise has a smooth coated surface, is poor in lubricating oil retentivity during press forming and is inferior in formability, the lubricating oil retentivity of the GI is enhanced by forming surface irregularities using the dull rolls.

In the temper rolling, the smooth coated surface of the GI is roughened by contact with the dull rolls. Portions contacted with temper rolling rolls are indented on the coated surface.

A GA which is alloyed after coating is also temper-rolled using the dull rolls after being alloyed. The GA has surface irregularities, formed by alloying, having a depth of several micrometers and those contacted with the dull rolls are mainly protrusions. Since protrusions on the surface of a galvanized steel sheet are portions which directly contact with a mold during press forming, it is important in enhancing sliding characteristics that a hard, high-melting point substance for preventing adhesion to the mold is present on the surface protrusions of the galvanized steel sheet.

From the above fact, the presence of an oxide layer on a coating surface layer is effective in enhancing sliding characteristics because the oxide layer prevents adhesion to a mold.

During actual press forming, oxides on a coating surface layer are worn and are scraped. Therefore, when the area of contact between a mold and a workpiece is large, a sufficiently thick oxide layer needs to be present on a coating surface at high coverage.

In usual, a coating, surface layer of a zinc-based coated steel sheet is provided with a thin continuous Al oxide layer. The thin Al oxide layer is not sufficient to obtain good sliding characteristics and therefore a thicker oxide layer needs to be formed.

With regard to the above, in an embodiment of the present invention, a zinc-based oxide layer is formed on a coating surface in such a manner that a steel sheet is zinc-coated, is temper-rolled, is brought into contact with an acidic solution, is held for 1 second to 60 seconds after the end of contact, and is then water-washed.

However, since an Al oxide layer of a coating surface layer of a zinc-based coated steel sheet is relatively stable to an acidic solution and inhibits the dissolution reaction of zinc during an acidic solution-contacting treatment, it is difficult to form zinc-based oxides on a portion in which Al oxides are present. This problem is significant for the GI because the concentration of the Al oxides in the coating surface layer is high in the GI. Thus, in order to form the zinc-based oxides, it is necessary that the Al-based oxide layer is removed before contact with the acidic solution or the Al-based oxides are removed by contact with the acidic solution.

Temper rolling is performed in the course of manufacturing a zinc-based coated steel sheet. In this operation, an Al oxide layer on a coating surface is physically removed at a portion contacting with a rolling roll (dull roll). Hitherto, temper rolling has been performed using dull rolls. Since the dull rolls have a surface roughness, Ra, of several micrometers, surface protrusions of the rolls mainly contact with a surface of a steel sheet. As a result, in the zinc-based coated steel sheet, only portions having contacted with the dull rolls are surface-activated and other portions are not surface-activated.

In the case of a GI, portions having contacted with surface protrusions of dull rolls are present in the form of recessed portions as compared to the surroundings and portions having not contacted with the surface protrusions of the dull rolls are present in the form of raised portions as compared to the surroundings. Thus, after temper rolling using conventional dull rolls, during contact with an acidic solution, zinc-based oxides are formed only on indentations having activated surfaces and are inhibited from being formed on protrusions having no activated surfaces. Those actually contacted with a press mold during press forming are mainly protrusions of a coated steel sheet and are not indentations provided with a zinc-based oxide layer. Therefore, the resultant improvement of press formability is little and is insufficient.

In the case of a GA, a coating film is different from an r layer in the case of a GI and is $\delta_1$-dominant layer; hence, the coating film is hard. Thus, even in temper rolling using conventional dull rolls, surface protrusions of the rolls contact with protrusions on a coating surface in large ratio, Al-based oxides present on protrusions likely to contact with a press mold during press forming are removed, and the protrusions are activated; hence, a relatively significant improving effect of sliding characteristic has been obtained. However, particularly under conditions where the surface pressure is increased, indentations contacted with no temper rolling rolls contact with a press mold in some cases. Therefore, zinc-based oxides have needed to be formed on such portions.

As a result of performing investigations on the basis of the above finding, in an embodiment of the present invention, an acidic treatment solution contains $HF_2Na$ and/or $HF_2K$ in a total amount of 0.10 g/L to 5.0 g/L. The presence of $HF_2Na$ and/or $HF_2K$ in the acidic treatment solution enhances the ability of the acidic treatment solution to etch Al-based oxides and eliminates the need for a step of removing the Al-based oxides, which inhibit the reaction, before contact with the acidic treatment solution.

As described above, the presence of Al-based oxides in a surface layer of a galvanized steel sheet inhibits the dissolution of Zn in the acidic treatment solution and therefore significantly reduces the reactivity. As a countermeasure, the acidic treatment solution contains $HF_2Na$ and/or $HF_2K$ in a total amount of 0.10 g/L to 5.0 g/L. Thus, the Al-based oxides are removed simultaneously with contact with the acidic treatment solution and therefore the dissolution reaction of Zn is not inhibited. When the total amount is less than 0.10 g/L, the time taken to remove the Al-based oxides is long, leading to a reduction in productivity. However, when the total amount is more than 5.0 g/L, the precipitation reaction of zinc-based oxides is reduced, leading to a reduction in productivity. From the above, the total amount of $HF_2Na$ and/or $HF_2K$ contained in the acidic solution is 0.10 g/L to 5.0 g/L. The ability of NaF and KF to etch the Al-based oxides is insufficient. HF is toxic to the human body, has too strong etching properties, therefore has a large impact on facilities, and is not industrially practical. Thus, in an embodiment the present invention, $HF_2Na$ and/or $HF_2K$ is used.

The acidic solution preferably contains at least one or more of surfactants among cationic surfactants, anionic surfactants, nonionic surfactants, and amphoteric surfactants.

In particular, a surface of a GI has low wettability to a treatment solution. Therefore, in a thin liquid film state, the treatment solution may possibly not become uniform. In this case, adding a surfactant to the treatment solution improves wettability to the treatment solution and is effective in enhancing sliding characteristics. The type of the surfactant is not particularly limited and may be one which can reduce surface energy to improve wettability. For example, at least one or more of surfactants among cationic surfactants, anionic surfactants, nonionic surfactants, and amphoteric surfactants may be contained in a total amount of 0.10 g/L or more. When the total amount is less than or equal to this level, an improving effect is insufficient in some cases. When the total amount is more than 5.0 g/L, the treatment solution foams to inhibit productivity in some cases.

The acidic solution preferably has a pH buffering action. When the acidic solution is a solution having the pH buffering action, a zinc-based oxide layer with excellent sliding characteristics can be stably formed on a flat portion of a coating surface.

A mechanism for forming the zinc-based oxide layer is not clear but may probably be as below. Contacting the galvanized steel sheet with the acidic solution causes the dissolution of zinc on the steel sheet side. The dissolution of zinc simultaneously causes a hydrogen generation reaction. Therefore, it is conceivable that the progress of the dissolution of zinc reduces the concentration of hydrogen ions in the solution to increase the pH of the solution and forms an oxide layer mainly containing zinc on a surface of the galvanized steel sheet. If the acidic solution, which has the pH buffering action, is used in this course, zinc is dissolved. Accordingly, even if the hydrogen generation reaction occurs, the increase in pH of the solution is moderate. Therefore, the dissolution of zinc proceeds and, as a result, zinc-based oxides sufficient to enhance sliding characteristics are formed.

The acidic solution, which has the pH buffering action, is particularly preferable to exhibit the pH buffering action in the pH range of 2.0 to 5.0. This is because using the acidic solution, which exhibits the pH buffering action in the above pH range, enables the zinc-based oxide layer, which is intended by an aspect of the present invention, to be stably obtained by holding a predetermined time after contact with the acidic-solution.

The acidic solution, which has such pH buffering action, may be an aqueous solution containing at least one or more of acetates such as sodium acetate ($CH_3COONa$), phthalates such as potassium phthalate ($(KOOC)_2C_6H_4$), citrates such as sodium citrate ($Na_3C_6H_5O_7$) and potassium dihydrogen citrate ($KH_2C_6H_5O_7$), succinates such as sodium succinate ($Na_2C_4H_4O_4$), lactates such as sodium lactate ($NaCH_3CHOHCO_2$), tartrates such as sodium tartrate ($Na_2C_4H_4O_6$), borates, phosphates, sulfates, and oxalates at a content of 5 g/L to 50 g/L. When the content is less than 5 g/L, the increase in pH of the solution occurs relatively quickly together with the dissolution of zinc and therefore any zinc-based oxide layer sufficient to enhance sliding characteristics cannot be formed. When the content is more than 50 g/L, it is conceivable that not only the dissolution of zinc is promoted and it takes a long time to form an oxide layer, but also the damage of a coating layer is serious, and an original role as a rust-proof steel sheet is lost.

The acidic solution preferably has a pH of 1.0 to 5.0. When the pH of the acidic solution is too low, the zinc-based oxides are hard to be formed, though the dissolution of zinc is promoted. However, when the pH thereof is too high, the rate of the dissolution reaction of zinc is reduced in some cases.

The zinc-based oxide layer is formed on a surface of a zinc-based coated steel sheet using the acidic solution, which have the above properties. Specifically, the zinc-based coated steel sheet is temper-rolled, is brought into contact with the above acidic solution, is held for 1 second to 60 seconds after the end of contact, is water-washed, and is then dried, whereby the zinc-based oxide layer is formed on a coating surface.

A method for contacting a galvanized steel sheet with the acidic solution is not particularly limited and may be one of such method as immersing a coated steel sheet in the acidic solution, spraying the acidic solution onto a coated steel sheet, applying the acidic solution to a coated steel sheet using a coating roll. It is preferable that the acidic solution is finally present on a surface of a steel sheet in the form of a thin liquid film. When the amount of a liquid film present on the steel sheet surface is small, any zinc-based oxide layer with a desired thickness cannot be formed on the coating surface. However, when the amount of the liquid film present on the steel sheet surface is too large, it is conceivable that the pH of the solution does not increase even though the dissolution of zinc occurs, only the dissolution of zinc continues, it takes a long time to form the zinc-based oxide layer, the damage of the coating layer is serious, and an original role as a rust-proof steel sheet is lost. From this viewpoint, it is effective to adjust the amount of the liquid film at the end of contact with the acidic solution to 1 $g/m^2$ to 15 $g/m^2$. The amount of the liquid film can be adjusted with a squeeze roll, by air wiping, or in a similar manner. The end of contact means the "end of immersion" for the method of immersing the coated steel sheet in the acidic solution, the "end of spraying" for the method of spraying the acidic solution onto the coated steel sheet, and the "end of application" for the method of applying the acidic solution to the coated steel sheet using the coating roll.

The time from the end of contact with the acidic solution to water washing (the holding time until water washing) needs to be 1 second to 60 seconds. This is because when the time until water washing is less than 1 second, the effect of enhancing sliding characteristics is not obtained, since the acidic solution is removed before the pH of the solution rises and the oxide layer mainly containing zinc is formed. However, when the time is more than 60 seconds, the amount of the zinc-based oxide layer does not vary.

The zinc-based oxide layer formed in the above step is held for 0.5 seconds or more in such a state that a surface of the zinc-based oxide layer is in contact with an alkaline aqueous solution, followed by water washing and then drying (a neutralization treatment).

If the acidic solution remains on a surface of a steel sheet after water washing and drying, then rust is likely to form while a coil of the steel sheet is stored for a long time. From the viewpoint of preventing the formation of such rust, the acidic solution remaining on the steel sheet surface is neutralized in such a manner that the steel sheet is brought into contact with an alkaline solution by a method such as immersing the steel sheet in the alkaline solution or spraying the alkaline solution on the steel sheet. In order to prevent the dissolution of the zinc-based oxide layer formed on a surface, the alkaline solution preferably has a pH of 12 or less. A solution used is not limited and sodium hydroxide, sodium pyrophosphate, or the like can be used.

Incidentally, in an embodiment of the present invention, the zinc-based oxides are oxides and hydroxides mainly containing zinc as a metal component and include those which contain metal components such as iron and Al such that the total amount of the metal components is less than the amount of zinc and those which contain anions such as sulfate anions, nitrate anions, and chlorine anions such that the total amount of the anions is less than the number of moles of oxygen and a hydroxyl group.

The zinc-based oxide layer contains an anionic component such as a sulfate ion used to adjust the pH of the acidic solution in some cases. Even if the anionic component, such as the sulfate ion; an impurity, such as S, N, P, B, Cl, Na, Mn, Ca, Mg, Ba, Sr, or Si, contained in the acidic solution, which has the pH buffering action; or a compound composed of S, N, P, B, Cl, Na, Mn, Ca, Mg, Ba, Sr, Si, 0, and/or C is incorporated in the zinc-based oxide layer, any effect of an embodiment of the present invention is not impaired.

EXAMPLES

The present invention is further described in detail with reference to the following non-limiting examples. Steel sheets which were annealed after being cold-rolled and which had a thickness of 0.7 mm were galvanized in accordance with common practice. Some of the steel sheets were alloyed after galvanizing. Next, temper rolling was performed. The zinc coating weight per unit area was adjusted to 45 $g/m^2$. After alloying, the Fe content of a coating film was adjusted to 10% by mass. After temper rolling, each steel sheet was immersed in an acidic solution which contained 30 g/L sodium acetate and which had a pH of 1.5 in an acidic solution tank and was then pulled out of the acidic solution. Thereafter, the amount of a liquid film attached to a surface of the steel sheet was adjusted with a squeeze roll placed on the delivery side of the acidic solution tank. The concentration of $HF_2Na$ and/or $HF_2K$ in the acidic solution was 0 g/L to 10.00 g/L and the temperature of the solution was 35° C. The amount of the liquid film was adjusted by varying the pressure of the squeeze roll. After the amount of the liquid film was adjusted, the steel sheet was left (held) for 1 second to 30 seconds, was washed by spraying 50° C. warm water on the steel sheet, and was then dried with a dryer, whereby a zinc-based oxide layer was formed on a surface of the coated steel sheet. After the amount of the liquid film was adjusted, some of the steel sheets were left (held) for a predetermined time, the acidic solution remaining on surfaces of the steel sheets was neutralized by spraying an alkaline solution (an aqueous solution of sodium pyrophosphate) having a pH of 10.54 and a temperature of 50° C., and 50° C. warm water was then sprayed on the steel sheets.

Zinc-based coated steel sheets obtained as described above were evaluated for press formability. The press formability (sliding characteristic during press forming) was evaluated by the coefficient of friction and the mold galling property.

A method for measuring the thickness of the zinc-based oxide layer, a method for determining the composition and crystal structure of the zinc-based oxide layer, a method for measuring the area fraction of zinc-based oxides, and a method for evaluating the sliding characteristic are as described below.

[1] Measurement of Thickness of Zinc-Based Oxide Layer

An X-ray fluorescence analyzer was used to measure the thickness of the zinc-based oxide layer. The voltage and current of a tube during measurement were 30 kV and 100 mA, respectively. The O-Kα radiation was detected by setting a dispersive crystal to TAP. Upon measuring the O—Kα radiation, intensity was measured at a background position in addition to the peak position thereof such that the net intensity of the O-Kα radiation could be calculated. Incidentally, the integration time at each of the peak position and the background position was 20 seconds. Silicon wafers provided with 96 nm, 54 nm, and 24 nm thick silicon oxide coatings cleaved into an appropriate size were simultaneously measured. The thickness of the zinc-based oxide layer was calculated from the measured intensities of the O-Kα radiation and the thickness of each silicon oxide coating.

[2] Method for Determining Composition and Crystal Structure of Zinc-Based Oxide Layer Analysis of Composition of Zinc-Based Oxide Layer An oxide layer only was dissolved from each zinc-based coated steel sheet using a solution containing 2% by mass ammonium dichromate and 14% by mass aqueous ammonia. The solution was quantitatively analyzed for Zn and S using an ICP emission spectrometer.

A surface of the oxide layer was scrubbed using a stainless steel brush having a diameter of 0.15 mm and a length of 45 mm and ethanol and an ethanol solution thereby obtained was suction-filtered, whereby a coating component was extracted in the form of a powder component. The coating component, which was extracted in the form of powder, was subjected to a programmed temperature analysis using a gas chromatograph-mass spectrometer, whereby C was quantitatively analyzed. A pyrolytic furnace was connected to the front end of the gas chromatograph-mass spectrometer. About 2 mg of an extracted powder sample was inserted into the pyrolytic furnace, the temperature in the pyrolytic furnace was increased from 30° C. to 500° C. at a heating rate of 5° C./min, and gas generated in the pyrolytic furnace was carried into the gas chromatograph-mass spectrometer, whereby the composition of the gas was analyzed. The column temperature of the gas chromatograph-mass spectrometer (GC/MS) during measurement was set to 300° C.

Existence Form of C

Likewise, the powered, extracted coating component was analyzed using the gas chromatograph-mass spectrometer, whereby the morphology of C was investigated.

Existence Form of Zn, S, and O

The existence form of Zn, S, and O was analyzed using an X-ray photoelectron spectrometer. The narrow scan measurement of a spectrum corresponding to each of Zn LMM and S 2p was performed using an Al Kα monochrome radiation source.

Determination of Crystallization Water

The weight loss at 100° C. or lower was measured using a differential thermobalance. About 15 mg of a powder sample was used for measurement. After the sample was introduced into the analyzer, the sample was heated from room temperature (about 25° C.) to 1,000° C. at a heating rate of 10° C./min and the thermogravimetric change during heating was recorded.

Determination of Crystal Structure

Likewise, the X-ray diffraction of the powered, extracted coating component was performed, whereby the crystal structure was estimated. A target used was Cu and measurement was performed under conditions including an accelerating voltage of 40 kV, a tube current of 50 mA, a scanning rate of 4 deg/min, and a scanning range of 2° to 90°.

As described above, in the zinc-based oxide layer, the thickness, Zn, S, C, the presence of zinc hydroxide, the presence of a carbonate, and the containing of a crystalline structure substance were measured and were determined.

[3] Measurement of Area Fraction of Formed Zinc-Based Oxides

Arbitrary 10 fields of view with a size of 35 μm×45 μm on a surface of each galvanized steel sheet were observed using an ultra-low-voltage SEM. For an obtained SEM image, the area fractions of portions provided with zinc-based oxides were measured from the difference in lightness between the portions provided with the zinc-based oxides and portions provided with no zinc-based oxides. The average thereof was defined as the area fraction of the formed zinc-based oxides.

[4] Method for Measuring Coefficient of Friction

In order to evaluate press formability, the coefficient of friction of each specimen was measured as described below. FIG. 1 is a schematic front view of a coefficient-of-friction tester. As shown in this figure, a coefficient-of-friction measurement sample 1 extracted from the specimen is fixed on a stage 2 and the stage 2 is fixed on the upper surface of a slide table 3 which is horizontally movable. A slide table support 5 which is vertically movable is placed under the lower surface of the slide table 3 and includes rollers 4 in contact therewith. The slide table support 5 is provided with a first load cell 7 for measuring the pressing load N to the coefficient-of-friction measurement sample 1 from a bead 6 by lifting the slide table support 5. An end portion of the slide table 3 is provided with a second load cell 8 for measuring the sliding resistance force F to horizontally move the slide table 3 in such a state that the pressing force is applied. Testing was carried out in such a manner that as a lubricating oil, a wash antirust oil (PRETON R352L, PRETON is a registered trademark) produced by Sugimura Chemical Industrial Co., Ltd. was applied to a surface of the sample 1.

Figure 2:
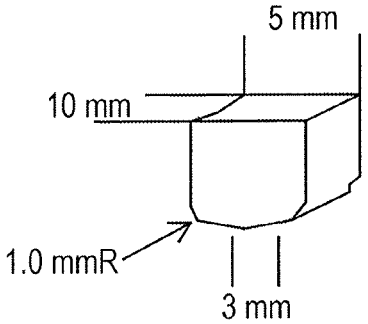
FIG. 2 is a schematic perspective view illustrating the shape and size of a bead in FIG. 1.
Figure 3:
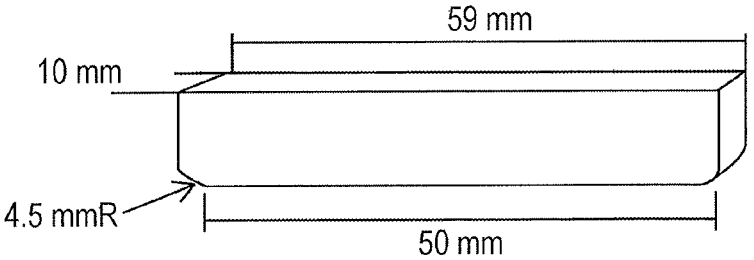
FIG. 3 is a schematic perspective view illustrating the shape and size of a bead in FIG. 1.

FIGS. 2 and 3 are schematic perspective views each illustrating the shape and size of a bead used. The bead 6 slides in such a state that the lower surface of the bead 6 is pressed against a surface of the sample 1. The bead 6 shown in FIG. 2 has a shape with a width of 10 mm and a length of 5 mm in a sliding direction of a sample and includes lower portions, each composed of a curved surface with a radius of curvature of 1.0 mm R, located at both ends in the sliding direction and the lower surface of the bead that is pressed against the sample has a flat face having a width of 10 mm and a length of 3 mm in the sliding direction. The bead 6 shown in FIG. 3 has a shape with a width of 10 mm and a length of 59 mm in a sliding direction of a sample and includes lower portions, each composed of a curved surface with a curvature of 4.5 mm R, located at both ends in the sliding direction and the lower surface of the bead that is pressed against the sample has a flat face having a width of 10 mm and a length of 50 mm in the sliding direction.

The coefficient of friction was measured under two conditions shown below.

[Condition 11]

The bead shown in FIG. 2 was used, the pressing load N was 400 kgf (3,922 N), and the drawing rate of a sample (the horizontal movement speed of the slide table 3) was 100 cm/min.

[Condition 2]

The bead shown in FIG. 3 was used, the pressing load N was 400 kgf (3,922 N), and the drawing rate of a sample (the horizontal movement speed of the slide table 3) was 20 cm/min. The coefficient of friction g between a specimen and a bead was calculated by the equation $\mu=F/N$.

[5] Method for Evaluating Mold Galling Property

GIs have a problem with mold galling that a coating on a portion with a long sliding distance adheres to a mold to cause an increase in sliding resistance. Therefore, a GI was evaluated for mold galling property in such a manner that a sliding test, aside from the measurement of the coefficient of friction, was repeatedly carried out 50 times using the coefficient-of-friction tester shown in FIG. 1; the number of repetitions that the coefficient of friction increases by 0.01 or more was investigated; and the number of the repetitions was defined as the limit number of repetitions before mold galling occurs. Here, the case where an increase in coefficient of friction by 0.01 or more was not observed after the sliding test was repeatedly carried out 50 times was rated as 50 times or more. A test condition was the same as Condition 1 in [4] Method for Measuring Coefficient of Friction.

Results obtained from the above and conditions are summarized in Tables 1 to 4.

TABLE 1

| | Oxide layer-forming treatment | | | | | | | | | | | | |
|---|---|---|---|---|---|---|---|---|---|---|---|---|---|
| | Acidic solution | | | | | | | | | | | | |
| | pH Buffering agent | | | | $HF_2Na$ and/or $HF_2K$ | | Surfactant | | | | Coating amount of acidic | | |
| No. | Chemical | Concentration (g/L) | pH Adjusting agent Chemical | pH | Chemical | Concentration (g/L) | Chemical | Concentration (g/L) | Degree of pH elevation | Temperature (° C.) | solution film ($g/m^2$) | Holding time (seconds) | Water washing |
| 1 | Not used | — | — | — | — | — | — | — | — | — | — | — | — |
| 2 | Sodium acetate trihydrate | 35 | Sulfuric acid | 1.5 | — | — | — | — | 0.20 | 35 | 5 | 10 | Performed |
| 3 | Sodium acetate trihydrate | 35 | Sulfuric acid | 1.5 | 1:1 Mixture of $HF_2Na$ and $HF_2K$ | 0.30 | — | — | 0.20 | 35 | 5 | 3 | Performed |
| 4 | | | | | | | | | | | | 5 | |
| 5 | | | | | | | | | | | | 10 | |
| 6 | | | | | | | | | | | | 30 | |
| 7 | | | | | | | | | | | | 60 | |
| 8 | Sodium acetate trihydrate | 35 | Sulfuric acid | 1.5 | 1:1 Mixture of $HF_2Na$ and $HF_2K$ | 0.05 | — | — | 0.20 | 35 | 5 | 10 | Performed |
| 9 | | | | | | 0.10 | | | | | | 10 | |
| 10 | | | | | | 0.30 | | | | | | 10 | |
| 11 | | | | | | 5.00 | | | | | | 10 | |
| 12 | | | | | | 10.00 | | | | | | 10 | |
| 13 | Sodium acetate trihydrate | 35 | Sulfuric acid | 1.5 | $HF_2Na$ | 0.05 | — | — | 0.20 | 35 | 5 | 10 | Performed |
| 14 | | | | | | 0.10 | | | | | | 10 | |
| 15 | | | | | | 0.30 | | | | | | 10 | |
| 16 | | | | | | 5.00 | | | | | | 10 | |
| 17 | | | | | | 10.00 | | | | | | 10 | |
| 18 | Sodium acetate trihydrate | 35 | Sulfuric acid | 1.5 | $HF_2K$ | 0.05 | — | — | 0.20 | 35 | 5 | 10 | Performed |
| 19 | | | | | | 0.10 | | | | | | 10 | |
| 20 | | | | | | 0.30 | | | | | | 10 | |
| 21 | | | | | | 5.00 | | | | | | 10 | |
| 22 | | | | | | 10.00 | | | | | | 10 | |
| 23 | Sodium acetate trihydrate | 35 | Sulfuric acid | 1.5 | 1:1 Mixture of $HF_2Na$ and $HF_2K$ | 0.30 | Na laurylsulfate | 0.05 | 0.20 | 35 | 5 | 10 | Performed |
| 24 | | | | | | | | 0.10 | | | | 10 | |
| 25 | | | | | | | | 1.00 | | | | 10 | |
| 26 | | | | | | | | 5.00 | | | | 10 | |
| 27 | | | | | | | | 10.00 | | | | 10 | |
| 28 | Sodium acetate trihydrate | 40 | Sulfuric acid | 1.5 | 1:1 Mixture of $HF_2Na$ and $HF_2K$ | 0.30 | Na laurylsulfate | 0.30 | 0.20 | 35 | 5 | 10 | Performed |
| 29 | | 45 | | | | | | | | | | 10 | |
| 30 | | 50 | | | | | | | | | | 10 | |
| 31 | | 60 | | | | | | | | | | 10 | |
| 32 | | 70 | | | | | | | | | | 10 | |

| | Neutralization treatment | | | | | | | | | |
|---|---|---|---|---|---|---|---|---|---|---|
| | Alkaline aqueous solution | | | | | Carbonate | | | | |
| | Phosphorus compound | | Carbonate ion | | P | ion | | | | |
| No. | Chemical | Concentration (g/L) | Chemical | Concentration (g/L) | concentration (g/L) | concentration (g/L) | pH | Stirring (rpm) | Temperature (° C.) | Immersion time (seconds) |
| 1 | Not used | — | — | — | — | — | — | — | — | — |
| 2 | Sodium pyrophosphate | 9.8 | Sodium carbonate decahydrate | 2.86 | 2.28 | 0.60 | 10.54 | 150 | 50 | 3 |
| 3 | Sodium pyrophosphate | 9.8 | Sodium carbonate decahydrate | 2.86 | 2.28 | 0.60 | 10.54 | 150 | 50 | 3 |
| 4 | | | | | | | | | | |
| 5 | | | | | | | | | | |
| 6 | | | | | | | | | | |
| 7 | | | | | | | | | | |
| 8 | Sodium pyrophosphate | 9.8 | Sodium carbonate decahydrate | 2.86 | 2.28 | 0.60 | 10.54 | 150 | 50 | 3 |
| 9 | | | | | | | | | | |
| 10 | | | | | | | | | | |
| 11 | | | | | | | | | | |
| 12 | | | | | | | | | | |

TABLE 1-continued

| | | | | | | | | | | |
|---|---|---|---|---|---|---|---|---|---|---|
| 13 | Sodium pyrophosphate | 9.8 | Sodium carbonate decahydrate | 2.86 | 2.28 | 0.60 | 10.54 | 150 | 50 | 3 |
| 14 | | | | | | | | | | |
| 15 | | | | | | | | | | |
| 16 | | | | | | | | | | |
| 17 | | | | | | | | | | |
| 18 | Sodium pyrophosphate | 9.8 | Sodium carbonate decahydrate | 2.86 | 2.28 | 0.60 | 10.54 | 150 | 50 | 3 |
| 19 | | | | | | | | | | |
| 20 | | | | | | | | | | |
| 21 | | | | | | | | | | |
| 22 | | | | | | | | | | |
| 23 | Sodium pyrophosphate | 9.8 | Sodium carbonate decahydrate | 2.86 | 2.28 | 0.60 | 10.54 | 150 | 50 | 3 |
| 24 | | | | | | | | | | |
| 25 | | | | | | | | | | |
| 26 | | | | | | | | | | |
| 27 | | | | | | | | | | |
| 28 | Sodium pyrophosphate | 9.8 | Sodium carbonate decahydrate | 2.86 | 2.28 | 0.60 | 10.54 | 150 | 50 | 3 |
| 29 | | | | | | | | | | |
| 30 | | | | | | | | | | |
| 31 | | | | | | | | | | |
| 32 | | | | | | | | | | |

20

TABLE 2

| | Oxide layer-forming treatment | | | | | | | | | | | | |
|---|---|---|---|---|---|---|---|---|---|---|---|---|---|
| | Acidic solution | | | | | | | | | | Coating amount of acidic solution film | | |
| | pH Buffering agent | | pH Adjusting agent | | $HF_2Na$ and/or $HF_2K$ | | Surfactant | | | | | | |
| No. | Chemical | Concentration (g/L) | Chemical | pH | Chemical | Concentration (g/L) | Chemical | Concentration (g/L) | Degree of pH elevation | Temperature (° C.) | (g/m$^2$) | Holding time (seconds) | Water washing |
| 33 | Not used | — | — | — | — | — | — | — | — | — | — | — | — |
| 34 | Sodium acetate trihydrate | 35 | Sulfuric acid | 1.5 | — | — | — | — | 0.20 | 35 | 5 | 3 | Performed |
| 35 | Sodium acetate trihydrate | 35 | Sulfuric acid | 1.5 | 1:1 Mixture of $HF_2Na$ and $HF_2K$ | 0.30 | — | — | 0.20 | 35 | 5 | 3 | Performed |
| 36 | | | | | | | | | | | | 5 | |
| 37 | | | | | | | | | | | | 10 | |
| 38 | | | | | | | | | | | | 30 | |
| 39 | | | | | | | | | | | | 60 | |

| | Neutralization treatment | | | | | | | | | |
|---|---|---|---|---|---|---|---|---|---|---|
| | Alkaline aqueous solution | | | | | | | | | |
| | Phosphorus compound | | Carbonate ion | | P | Carbonate ion | | | | |
| No. | Chemical | Concentration (g/L) | Chemical | Concentration (g/L) | concentration (g/L) | concentration (g/L) | pH | Stirring (rpm) | Temperature (° C.) | Immersion time (seconds) |
| 33 | Not used | — | — | — | — | — | — | — | — | — |
| 34 | Sodium pyrophosphate | 9.8 | Sodium carbonate decahydrate | 2.86 | 2.28 | 0.60 | 10.54 | 150 | 50 | 3 |
| 35 | Sodium pyrophosphate | 9.8 | Sodium carbonate decahydrate | 2.86 | 2.28 | 0.60 | 10.54 | 150 | 50 | 3 |
| 36 | | | | | | | | | | |
| 37 | | | | | | | | | | |
| 38 | | | | | | | | | | |
| 39 | | | | | | | | | | |

TABLE 3

| No. | Analysis results of zinc-based oxide layer: Thickness (O) (nm) | Zn (mg/m$^2$) | S (mg/m$^2$) | C (mg/m$^2$) | Presence of zinc hydroxide | Presence of sulfate | Presence of carbonate | Confirmation of containing of crystalline structure substance | Area fraction of formed zinc-based oxides | Press formability Coefficient of friction: Condition 1 | Condition 2 | Mold galling | Remarks |
|---|---|---|---|---|---|---|---|---|---|---|---|---|---|
| 1 | 8 | 21 | 0.0 | 0.0 | X | X | X | X | 0% | 0.146 | 0.296 | 4 | Comparative example |
| 2 | 18 | 48 | 4.7 | 0.4 | ○ | ○ | ○ | ○ | 45% | 0.121 | 0.253 | 8 | Comparative example |
| 3 | 28 | 74 | 7.3 | 0.7 | ○ | ○ | ○ | ○ | 70% | 0.098 | 0.198 | 13 | Inventive example |
| 4 | 35 | 92 | 9.1 | 0.9 | ○ | ○ | ○ | ○ | 75% | 0.089 | 0.183 | 15 | Inventive example |
| 5 | 48 | 127 | 12.5 | 1.2 | ○ | ○ | ○ | ○ | 80% | 0.081 | 0.172 | 18 | Inventive example |
| 6 | 62 | −164 | 16.1 | 1.5 | ○ | ○ | ○ | ○ | 85% | 0.072 | 0.159 | 21 | Inventive example |
| 7 | 89 | 235 | 23.1 | 2.2 | ○ | ○ | ○ | ○ | 85% | 0.068 | 0.148 | 25 | Inventive example |
| 8 | 19 | 50 | 4.9 | 0.5 | ○ | ○ | ○ | ○ | 50% | 0.119 | 0.241 | 7 | Comparative example |
| 9 | 36 | 95 | 9.4 | 0.9 | ○ | ○ | ○ | ○ | 70% | 0.085 | 0.196 | 16 | Inventive example |
| 10 | 48 | 127 | 12.5 | 1.2 | ○ | ○ | ○ | ○ | 80% | 0.079 | 0.175 | 19 | Inventive example |
| 11 | 34 | 90 | 8.8 | 0.8 | ○ | ○ | ○ | ○ | 80% | 0.083 | 0.181 | 14 | Inventive example |
| 12 | 19 | 50 | 4.9 | 0.5 | ○ | ○ | ○ | ○ | 80% | 0.109 | 0.231 | 8 | Comparative example |
| 13 | 18 | 48 | 4.7 | 0.4 | ○ | ○ | ○ | ○ | 50% | 0.105 | 0.261 | 7 | Comparative example |
| 14 | 37 | 98 | 9.6 | 0.9 | ○ | ○ | ○ | ○ | 70% | 0.086 | 0.183 | 13 | Inventive example |
| 15 | 50 | 132 | 13.0 | 1.2 | ○ | ○ | ○ | ○ | 80% | 0.075 | 0.165 | 19 | Inventive example |
| 16 | 33 | 87 | 8.6 | 0.8 | ○ | ○ | ○ | ○ | 80% | 0.087 | 0.184 | 15 | Inventive example |
| 17 | 16 | 42 | 4.2 | 0.4 | ○ | ○ | ○ | ○ | 80% | 0.108 | 0.229 | 6 | Comparative example |
| 18 | 17 | 45 | 4.4 | 0.4 | ○ | ○ | ○ | ○ | 50% | 0.108 | 0.247 | 8 | Comparative example |
| 19 | 35 | 92 | 9.1 | 0.9 | ○ | ○ | ○ | ○ | 70% | 0.085 | 0.185 | 15 | Inventive example |
| 20 | 51 | 135 | 13.3 | 1.2 | ○ | ○ | ○ | ○ | 80% | 0.073 | 0.164 | 19 | Inventive example |
| 21 | 32 | 84 | 8.3 | 0.8 | ○ | ○ | ○ | ○ | 80% | 0.083 | 0.179 | 14 | Inventive example |
| 22 | 19 | 50 | 4.9 | 0.5 | ○ | ○ | ○ | ○ | 80% | 0.110 | 0.228 | 7 | Comparative example |
| 23 | 51 | 135 | 13.3 | 1.2 | ○ | ○ | ○ | ○ | 90% or more | 0.073 | 0.171 | 20 | Inventive example |
| 24 | 53 | 140 | 13.8 | 1.3 | ○ | ○ | ○ | ○ | 90% or more | 0.072 | 0.168 | 21 | Inventive example |
| 25 | 54 | 143 | 14.0 | 1.3 | ○ | ○ | ○ | ○ | 90% or more | 0.073 | 0.163 | 23 | Inventive example |
| 26 | 56 | 148 | 14.6 | 1.4 | ○ | ○ | ○ | ○ | 90% or more | 0.071 | 0.160 | 24 | Inventive example |
| 27 | 58 | 153 | 15.1 | 1.4 | ○ | ○ | ○ | ○ | 90% or more | 0.068 | 0.158 | 25 | Inventive example |
| 28 | 56 | 148 | 14.6 | 1.4 | ○ | ○ | ○ | ○ | 90% or more | 0.071 | 0.160 | 24 | Inventive example |
| 29 | 59 | 156 | 15.3 | 1.4 | ○ | ○ | ○ | ○ | 90% or more | 0.069 | 0.155 | 26 | Inventive example |
| 30 | 62 | 164 | 16.1 | 1.5 | ○ | ○ | ○ | ○ | 90% or more | 0.066 | 0.152 | 27 | Inventive example |
| 31 | 64 | 169 | 16.6 | 1.6 | ○ | ○ | ○ | ○ | 90% or more | 0.065 | 0.153 | 27 | Inventive example |
| 32 | 63 | 166 | 16.4 | 1.5 | ○ | ○ | ○ | ○ | 90% or more | 0.063 | 0.150 | 27 | Inventive example |

* ○: confirmed.
X: not confirmed.
The crystalline structure substance is $Zn_4(SO_4)_{1-x}(CO_3)_x(OH)_6 \cdot nH_2O$.

TABLE 4

| No. | Analysis results of zinc-based oxide layer: Thickness (O) (nm) | Zn (mg/m$^2$) | S (mg/m$^2$) | C (mg/m$^2$) | Presence of zinc hydroxide | Presence of sulfate | Presence of carbonate | Confirmation of containing of crystalline structure substance | Area fraction of formed zinc-based oxides | Press formability Coefficient of friction: Condition 1 | Condition 2 | Mold galling | Remarks |
|---|---|---|---|---|---|---|---|---|---|---|---|---|---|
| 33 | 8 | 21 | 0.0 | 0.0 | X | X | X | X | 0% | 0.181 | 0.243 | 4 | Comparative example |
| 34 | 19 | −50 | 4.9 | 0.5 | ○ | ○ | ○ | ○ | 45% | 0.147 | 0.253 | 8 | Comparative example |
| 35 | 24 | 63 | 6.2 | 0.6 | ○ | ○ | ○ | ○ | 65% | 0.135 | 0.195 | 13 | Inventive example |
| 36 | 35 | 92 | 9.1 | 0.9 | ○ | ○ | ○ | ○ | 70% | 0.134 | 0.184 | 15 | Inventive example |
| 37 | 45 | 119 | 11.7 | 1.1 | ○ | ○ | ○ | ○ | 70% | 0.128 | 0.172 | 18 | Inventive example |

TABLE 4-continued

| | Analysis results of zinc-based oxide layer | | | | | | | | | Press formability Coefficient of friction | | | |
|---|---|---|---|---|---|---|---|---|---|---|---|---|---|
| No. | Thickness (O) (nm) | Zn ($mg/m^2$) | S ($mg/m^2$) | C ($mg/m^2$) | Presence of zinc hydroxide | Presence of sulfate | Presence of carbonate | Confirmation of containing of crystalline structure substance | Area fraction of formed zinc-based oxides | Condition 1 | Condition 2 | Mold galling | Remarks |
| 38 | 52 | 137 | 13.5 | 1.3 | ○ | ○ | ○ | ○ | 70% | 0.125 | 0.158 | 21 | Inventive example |
| 39 | 59 | 156 | 15.3 | 1.4 | ○ | ○ | ○ | ○ | 70% | 0.120 | 0.153 | 25 | Inventive example |

* ○: confirmed.
X: not confirmed.
The crystalline structure substance is $Zn_4(SO_4)_{1-x}(CO_3)_x(OH)_6 \cdot nH_2O$.

From Tables 1, 2, 3, and 4, items below became apparent.

(1) GIs: Nos. 1 to 32

In inventive examples in which an oxide-forming treatment was performed by contact with an acidic treatment solution containing $HF_2Na$ and/or $HF_2K$ in an appropriate range, a sufficient thickness of coating is obtained as compared to comparative examples. Those with a surfactant addition have an increased thickness of coating for the same holding time and more stable press formability (sliding characteristic). Detailed coating analyses were performed for No. 32, so that the following became clear.

From results of a gas chromatograph-mass analysis, the release of $CO_2$ was confirmed between 150° C. to 500° C., which showed that C was present in the form of a carbonate. As a result of performing an analysis using the X-ray photoelectron spectrometer, a peak corresponding to Zn LMM was observed at about 987 eV, which showed that Zn was present in the form of zinc hydroxide.

Likewise, a peak corresponding to S 2p was observed at about 171 eV, which showed that S was present in the form of a sulfate.

From results of the differential thermobalance, a weight loss of 11.2% was observed at 100° C. or lower, which showed that crystallization water was contained. From results of X-ray diffraction, diffraction peaks were observed at a 2θ of about 8.5°, 15.0°, 17.4°, 21.3°, 23.2°, 26.3°, 27.7°, 28.7°, 32.8°, 34.1°, 58.6°, and 59.4°.

From the above results, the composition ratio, and the charge balance, a crystalline structure substance represented by $Zn_4(SO_4)_{0.95}(CO_3)_{0.05}(OH)_6.3.3H_2O$ was contained. Detailed coating analyses were performed for No. 28, so that the following became clear.

From results of a gas chromatograph-mass analysis, the release of $CO_2$ could be confirmed between 150° C. to 500° C., which showed that C was present in the form of a carbonate. As a result of performing an analysis using the X-ray photoelectron spectrometer, a peak corresponding to Zn LMM was observed at about 987 eV, which showed that Zn was present in the form of zinc hydroxide.

Likewise, a peak corresponding to S 2p was observed at about 171 eV, which showed that S was present in the form of a sulfate.

From results of the differential thermobalance, a weight loss of 9.4% was observed at 100° C. or lower, which showed that crystallization water was contained.

From results of X-ray diffraction, diffraction peaks were observed at a 2θ of about 8.8°, 15.0°, 17.9°, 21.3°, 23.2°, 27.0°, 29.2°, 32.9°, 34.7°, and 58.9°.

From the above results, the composition ratio, and the charge balance, a crystalline structure substance represented by $Zn_4(SO_4)_{0.8}(CO_3)_{0.2}(OH)_6.2.7H_2O$ was contained.

(2) GAs: Nos. 33 to 39

In inventive examples in which an oxide-forming treatment was performed by contact with an acidic treatment solution containing $HF_2Na$ and/or $HF_2K$ in an appropriate range, a sufficient thickness of coating is obtained as compared to comparative examples and excellent press formability is obtained.

A zinc-based coated steel sheet according to aspects of the present invention is excellent in press formability and therefore can be used in a wide range of fields, especially for automotive body applications.

REFERENCE SIGNS LIST

1 Coefficient-of-friction measurement sample
2 Stage
3 Slide table
4 Rollers
5 Slide table support
6 Bead
7 First load cell
8 Second load cell
9 Rail
N Pressing load
F Sliding resistance force

The invention claimed is:

1. A method for manufacturing a zinc-based coated steel sheet having a zinc-based oxide layer on a surface thereof, the method comprising:

an oxide layer-forming step of bringing the zinc-based coated steel sheet into contact with an acidic solution, holding the zinc-based coated steel sheet for 1 second to 60 seconds, and then water-washing the zinc-based coated steel sheet; and a neutralization step of holding a zinc-based oxide layer formed in the oxide layer-forming step for 0.5 seconds or more in such a state that a surface of the zinc-based oxide layer is in contact with an alkaline aqueous solution, water-washing the zinc-based oxide layer, and then drying the zinc-based oxide layer, wherein the acidic solution contains $HF_2Na$ and/or $HF_2K$ in a total amount of 0.10 g/L to 5.0 g/L.

2. The method for manufacturing the zinc-based coated steel sheet according to claim 1, wherein the acidic solution contains at least one or more of surfactants among cationic surfactants, anionic surfactants, nonionic surfactants, and amphoteric surfactants.

3. The method for manufacturing the zinc-based coated steel sheet according to claim 1, wherein the zinc-based oxide layer contains a crystalline structure substance represented by $Zn_4(SO_4)_{1-x}(CO_3)_x(OH)_6.nH_2O$.

4. The method for manufacturing the zinc-based coated steel sheet according to claim 2, wherein the zinc-based oxide layer contains a crystalline structure substance represented by $Zn_4(SO_4)_{1-x}(CO_3)_x(OH)_6.nH_2O$.

* * * * *